US011448450B2

(12) United States Patent
Liu et al.

(10) Patent No.: US 11,448,450 B2
(45) Date of Patent: Sep. 20, 2022

(54) REFRIGERATOR AND CONTROL METHOD THEREOF

(71) Applicants: QINGDAO HAIER REFRIGERATOR CO., LTD., Qingdao (CN); HAIER SMART HOME CO., LTD., Qingdao (CN)

(72) Inventors: Mingyong Liu, Qingdao (CN); Ning Wang, Qingdao (CN); Shidong Li, Qingdao (CN); Yuan Wang, Qingdao (CN); Heng Zhang, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 220 days.

(21) Appl. No.: 17/040,502

(22) PCT Filed: Aug. 15, 2019

(86) PCT No.: PCT/CN2019/100735
§ 371 (c)(1),
(2) Date: Sep. 22, 2020

(87) PCT Pub. No.: WO2020/181721
PCT Pub. Date: Sep. 17, 2020

(65) Prior Publication Data

US 2021/0025637 A1 Jan. 28, 2021

(30) Foreign Application Priority Data

Mar. 13, 2019 (CN) ..... 201910187405.3

(51) Int. Cl.
*F25D 11/02* (2006.01)
*F25D 23/02* (2006.01)
(Continued)

(52) U.S. Cl.
CPC ..... *F25D 11/02* (2013.01); *F25D 23/028* (2013.01); *F25D 27/00* (2013.01); *F25D 29/005* (2013.01); *F25D 2323/023* (2013.01)

(58) Field of Classification Search
CPC ..... F25D 2323/023; F25D 23/028; F25D 2700/02; F25D 2700/04; F25D 27/005; F25D 29/00; F25D 29/005
See application file for complete search history.

(56) References Cited

U.S. PATENT DOCUMENTS

2015/0223618 A1* 8/2015 Maasen ..... F25D 23/02 53/473
2015/0228253 A1* 8/2015 Lee ..... G09G 5/30 345/592

(Continued)

FOREIGN PATENT DOCUMENTS

CN 103913028 A 7/2014
CN 105008830 A 10/2015

(Continued)

*Primary Examiner* — Filip Zec
(74) *Attorney, Agent, or Firm* — Cheng-Ju Chiang

(57) ABSTRACT

The present invention discloses a refrigerator and a control method thereof. The refrigerator comprises a door body with an inner door and an outer door, a locking mechanism for locking the outer door, an unlocking mechanism for unlocking the outer door, and a detection unit for detecting an open state and a closed state of the inner door. The present disclosure avoids damages caused by collision between the inner door and the outer door when the outer door is opened, and also avoids simultaneous opening of the inner door and outer door and facilitates the user to use and achieves an energy-saving effect.

10 Claims, 1 Drawing Sheet

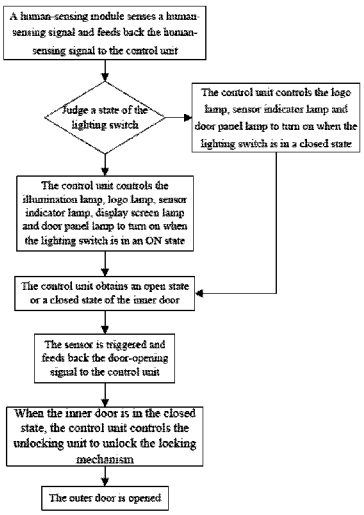

(51) Int. Cl.
*F25D 27/00* (2006.01)
*F25D 29/00* (2006.01)

(56) References Cited

U.S. PATENT DOCUMENTS

2015/0276302 A1* 10/2015 Roh ..... G09G 3/3406
62/127
2017/0191746 A1 7/2017 Seo

FOREIGN PATENT DOCUMENTS

| | | | |
|---|---|---|---|
| CN | 105698472 | A | 6/2016 |
| CN | 205619649 | U | 10/2016 |
| CN | 106895638 | A | 6/2017 |
| KR | 10-2018-0015971 | A | 2/2018 |

* cited by examiner

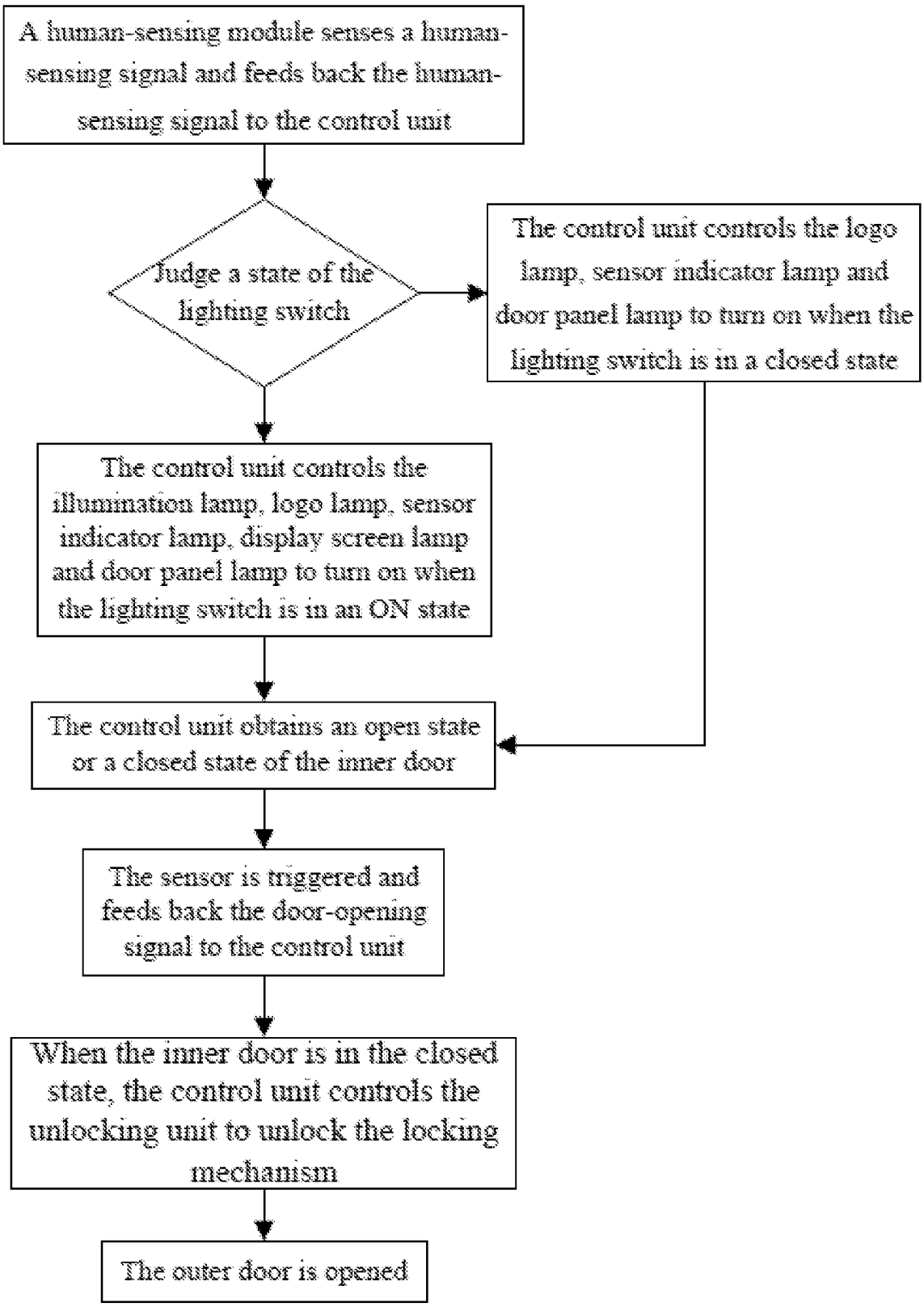
A human-sensing module senses a human-sensing signal and feeds back the human-sensing signal to the control unit
Judge a state of the lighting switch
The control unit controls the logo lamp, sensor indicator lamp and door panel lamp to turn on when the lighting switch is in a closed state
The control unit controls the illumination lamp, logo lamp, sensor indicator lamp, display screen lamp and door panel lamp to turn on when the lighting switch is in an ON state
The control unit obtains an open state or a closed state of the inner door
The sensor is triggered and feeds back the door-opening signal to the control unit
When the inner door is in the closed state, the control unit controls the unlocking unit to unlock the locking mechanism
The outer door is opened

REFRIGERATOR AND CONTROL METHOD THEREOF

CROSS REFERENCE TO RELATED APPLICATIONS

The present application is a 35 U.S.C. § 371 National Phase conversion of International (PCT) Patent Application No. PCT/CN2019/100735, filed on Aug. 15, 2019, which claims benefit of Chinese patent application No. 201910187405.3 filed on Mar. 13, 2019, the disclosure of which is incorporated by reference herein. The PCT International Patent Application was filed and published in Chinese.

TECHNICAL FIELD

The present invention relates to the field of refrigeration devices and in particular to a refrigerator and a control method thereof.

BACKGROUND

As users' requirements for refrigerators increase gradually, large refrigerator manufacturers in the field sequentially develop side-by-side refrigerators and four-door large refrigerators to increase the volume of refrigerators and provide more receiving spaces. However, doors of the refrigerators are heavy, frequent opening causes serious leakage of cold and more loss of energy, and cannot satisfy the user's demands to save energy. Hence, door-in-door refrigerators are developed.

A door-in-door refrigerator generally includes a cabinet, an inner door and an outer door rotatably coupled to the cabinet, wherein the inner door is closed via a door seal. A locking mechanism and an unlocking mechanism are disposed between the outer door and the inner door. When the locking mechanism is in a locked state, the outer door is in a closed state, whereupon the user may open the inner door. It may be appreciated that while the user opens or closes the inner door, the outer door and inner door turn synchronously; when the user needs to open the outer door only, he triggers a sensor. After receiving a door-opening signal fed back by the sensor, a control unit of the refrigerator controls the unlocking mechanism to unlock the locking mechanism, so that the user can open the outer door alone, prevent leakage of cold and facilitate the user to access articles.

However, when the inner door is in an open state or not completely closed, if the user opens the outer door alone, the inner door will collide with the outer door, thereby causing damages; even the inner door will be opened together with the outer door, thereby causing leakage of cold.

In view of the above problems, it is necessary to provide a novel refrigerator and a control method thereof to solve the above problems.

SUMMARY

An object of the present invention is to provide a refrigerator and a control method thereof to facilitate the user to use.

To achieve the above object, the present invention employs the following technical solutions:

A refrigerator, comprising a cabinet, a door body which surrounds together with the cabinet to form a refrigerating compartment, and a control unit, the door body comprising an inner door and an outer door rotatably coupled to the cabinet, the refrigerator further comprising a locking mechanism for locking the outer door and an unlocking mechanism for unlocking the outer door, the unlocking mechanism comprising a sensor disposed on the outer door and configured to obtain a door-opening signal of the outer door, and an unlocking unit for unlocking the locking mechanism, the sensor and the unlocking unit being both communicatively connected with the control unit; the refrigerator further comprises a detection unit which is configured to detect an open state or a closed state of the inner door and is communicatively connected with the control unit; the control unit controls the unlocking unit to unlock the locking mechanism upon receiving the door-opening signal of the sensor and judging that the inner door is in the closed state.

In further, the refrigerator further comprises a human-sensing module communicatively connected with the control unit, and the control unit obtains a feedback signal from the detection unit when the control unit receives a human-sensing signal fed back by the human-sensing module.

In further, the outer door is configured as a transparent door body, and the refrigerator further comprises a plurality of lighting lamp group communicatively connected with the control unit, and the control unit controls at least a portion of the lighting lamp groups to turn on after the control unit receives the human-sensing signal.

In further, the refrigerator further comprises a display screen set disposed on the door body, a second refrigerating compartment and a door-opening sensing plate disposed on the door body and configured to open the second refrigerating compartment; the plurality of lighting lamp groups comprise an illumination lamp disposed in the first refrigerating compartment, a logo lamp for lighting a logo of the refrigerator, a sensor indicator lamp corresponding to the sensor, a display screen lamp for lighting a display and control screen set, and a door panel lamp for lighting the door-opening sensing plate.

In further, the refrigerator further comprises a lighting switch communicatively connected with the control unit; when the lighting switch is turned on, the control unit controls the illumination lamp, logo lamp, sensor indicator lamp, display screen lamp and door panel lamp to turn on; when the lighting switch is turned off, the control unit controls the logo lamp, the sensor indicator lamp and the door panel lamp to turn on.

In further, the detection unit comprises a magnet disposed on one of the inner door and the cabinet, and a Hall element disposed on the other of the inner door and the cabinet, and the Hall element communicatively connected with the control unit.

To achieve the above object, the present invention also provides a control method of a refrigerator, wherein the refrigerator is configured as the refrigerator according to the above mentioned, and the control method comprises the following steps:

the control unit obtains the open state or closed state of the inner door;

when the inner door is in the closed state, after the sensor is triggered and a door-opening signal is fed back to the control unit, the control unit controls the unlocking unit to unlock the locking mechanism.

In further, the refrigerator further comprises a human-sensing module communicatively connected with the control unit; before the control unit obtains the open state or closed state of the inner door, the control method further comprises the following steps:

the human-sensing module senses the human-sensing signal and feeds it back to the control unit.

In further, the outer door is configured as a transparent door body, the refrigerator further comprises a plurality of lighting lamp groups communicatively connected with the control unit, the control method further comprises a step of the control unit controlling at least a portion of the lighting lamp groups to turn on, after the control unit receives the human-sensing signal fed back by the human-sensing module and before the sensor is triggered.

In further, the refrigerator further comprises a display screen set disposed on the door body, a second refrigerating compartment, a door-opening sensing plate disposed on the door body and configured to open the second refrigerating compartment, and a lighting switch communicatively connected with the control unit; the plurality of lighting lamp groups comprise an illumination lamp disposed in the first refrigerating compartment, a logo lamp for lighting a logo of the refrigerator, a sensor indicator lamp corresponding to the sensor, a display screen lamp for lighting a display and control screen set, and a door panel lamp for lighting the door-opening sensing plate; the control unit controlling at least a portion of the lighting lamp groups to turn on specifically comprises the following steps: judging a state of the lighting switch, the control unit controlling the illumination lamp, logo lamp, sensor indicator lamp, display screen lamp and door panel lamp to turn on when the lighting switch is in an ON state; when the lighting switch is in an OFF state, the control unit controls the logo lamp, the sensor indicator lamp and the door panel lamp to turn on.

Advantageous effects of the present invention are as follows: in the present invention, only when the inner door is in the closed state can the outer door be opened alone, thereby avoiding damages caused by collision between the inner door and the outer door when the outer door is opened, and also avoiding simultaneous opening of the inner door and outer door and facilitating the user to use and achieve the energy-saving effect.

BRIEF DESCRIPTION OF THE DRAWINGS

The FIGURE is a flow chart of a control method in the present invention.

DETAILED DESCRIPTION

The present invention will be described in detail in conjunction with embodiments shown in the figures. Referring to the FIGURE, it shows a preferred embodiment of the present invention.

The present invention provides a refrigerator, comprising a cabinet, a door body which surrounds together with the cabinet to form a refrigerating compartment, a refrigerating system providing cold to the refrigerating compartment and a control unit, wherein the refrigerating system is communicatively communicated with the control unit. The structure and principle of the refrigerating system in the present invention may conform to the structure and principle of a commonly-used refrigerating system in the art, so long as it can refrigerate the refrigerating compartment when the refrigerating compartment needs to be refrigerated. This will not be detailed any more here.

In a specific embodiment, the refrigerator is a French-type refrigerator, i.e., the refrigerating compartment comprises a first refrigerating compartment, and at least one second refrigerating compartment below the first refrigerating compartment, wherein the first refrigerating compartment is a side-by-side refrigerating chamber, and the second refrigerating compartment is a drawer-type freezing chamber. Certainly, the refrigerating compartments are not limited to this.

Hereunder, the refrigerator will be specifically illustrated by taking a French-type refrigerator as an example. Certainly, it may be appreciated that the refrigerator of the invention may also be applied to other refrigerators, for example, four-door refrigerators, etc.

The door body comprises a left refrigerating door body and a right refrigerating door body which are arranged opposite, and the left refrigerating door body and the right refrigerating door body are both rotatably coupled to the cabinet to open or close the first refrigerating compartment.

In a specific embodiment, the left refrigerating door body is a door-in-door structure, that is, the left refrigerating door body comprises an inner door and an outer door rotatably coupled to the cabinet. Certainly, the present invention is not limited thereto. It may be understood that the right refrigerating door body may also be provided as a door-in-door structure, or each of the left refrigerating door body and the right refrigerating door body are provided as a door-in-door structure.

Furthermore, the refrigerator further comprises a display screen set disposed on the door body, and a door-opening sensing plate disposed on the door body and configured to automatically open the second refrigerating compartment.

Specifically, the display screen set comprises a first display screen disposed on the inner door and a second display screen disposed on the right refrigerating door body. Certainly, the display screen set is not limited thereto.

The door-opening sensing plate is communicatively connected with the control unit. In the present embodiment, the door-opening sensing plate is disposed in a way that upon sliding along a predetermined trajectory, the user can obtain a door-opening signal of the second refrigerating compartment, and the control unit controls the second refrigerating compartment to open; certainly, the door-opening sensing plate is not limited to this. For example, the door-opening sensing plate may also be disposed in a way that the door-opening signal can be obtained when the user touches it softly.

Furthermore, the refrigerator further comprises a detection unit which is configured to detect an open state or a closed state of the inner door, and is communicatively connected with the control unit. The control unit can obtain the open state or closed state of the inner door according to a feedback signal from the detection unit.

In a specific embodiment, the detection unit comprises a magnet disposed on one of the inner door and the cabinet, and a Hall element disposed on the other of the inner door and the cabinet, and the hall element communicatively connected with the control unit. The control unit judges the open state or closed state of the inner door according to a level output by the Hall element. Specifically, when the Hall element outputs a low level, the control unit judges that the inner door is in the closed state; when the Hall element outputs a high level, the control unit judges that the inner door is in the open state.

Certainly, the present disclosure is not limited thereto. For example, a microswitch communicatively connected with the control unit may be also provided to sense the open state or closed state of the inner door. It may be appreciated that the detection unit is feasible so long as the control unit can judge the open state or closed state of the inner door according to the feedback signal from the detection unit.

Furthermore, the refrigerator further comprises a locking mechanism for locking the outer door, and an unlocking mechanism for unlocking the outer door. When the locking mechanism is in a locked state, the outer door and the inner door are interlocked, whereupon the outer door is in a closed state; when the unlocking mechanism unlocks the locking mechanism, that is, when the locking mechanism is in the unlocked state, the user may open the outer door alone.

In a specific embodiment, the locking mechanism is an electromagnetic lock. Of course, it is not limited to this. For example, the locking mechanism may also be configured as a latch or a catch that mate with each other.

Furthermore, the unlocking mechanism includes a sensor arranged on the outer door and configured to obtain the door-opening signal of the outer door, and an unlocking unit for unlocking the locking mechanism. The sensor and the unlocking unit are both communicatively connected with the control unit. It may be appreciated that in the embodiment where the locking mechanism is an electromagnetic lock, the control unit controls the unlocking unit to power off the electromagnetic lock to realize unlocking of the locking mechanism; in an embodiment where the locking mechanism is a latch and a catch which mate each other, the unlocking unit may be configured as a driving unit that drives the latch to move to a position where the latch is disengaged from the catch, to unlock the locking mechanism.

In this embodiment, the sensor can obtain a door-opening signal when lightly touched by a human body, such as a touch sensor. Of course, the sensor is not limited to this.

After the control unit receives the door-opening signal fed back by the sensor, the control unit controls the unlocking unit according to the open state or closed state of the inner door. Specifically, the control unit will control the unlocking unit to unlock the locking mechanism only when the inner door is in the closed state. It may be appreciated that if the inner door is in the open state, even if the user triggers the sensor, the control unit will not control the unlocking unit to unlock the locking mechanism, thereby ensuring that the inner door is in a closed state when the outer door is opened alone, thereby avoiding damages caused by collision between the inner door and the outer door, and also avoiding simultaneous opening of the inner door and outer door and facilitating the user to use and achieve an energy-saving effect.

Furthermore, the refrigerator further includes a human-sensing module communicatively connected with the control unit and configured to sense whether there is a person within a preset distance in front of the refrigerator. After the human-sensing module senses a human-sensing signal and feeds it back to the control unit, the control unit judges that the user might perform the next operation on the refrigerator. At this time, the control unit judges the open state or closed state of the inner door according to the feedback signal of the detection unit, to control the unlocking unit according to the open state or closed state of the inner door after the user triggers the sensor.

The human-sensing module may employ an infrared sensor, a light sensor, a camera module, etc. It may be understood that the human-sensing module is not limited to the above-mentioned structure, as long as it can sense whether there is a person within a preset distance in front of the refrigerator.

Further, the outer door is configured as a transparent door body, and the refrigerator further includes a plurality of lighting lamp group communicatively connected with the control unit. After the control unit receives the human-sensing signal, the control unit controls at least a portion of the lighting lamp groups to turn on to help the user to view and manipulate.

In a specific embodiment, the plurality of lighting lamp groups includes an illumination lamp disposed in the first refrigerating compartment, a logo lamp for lighting a logo of the refrigerator, a sensor indicator lamp corresponding to the sensor, a display screen lamp for lighting a display and control screen set, and a door panel lamp for lighting the door-opening sensing plate; however, the lighting lamp groups are not limited to this. It may be appreciated that the lighting lamp groups may be increased or decreased according to the specific configuration of the refrigerator.

The control unit controls the illumination lamp to turn on, so that the user can view the items in the first refrigerating compartment, that is, the user can view the items in the first refrigerating compartment without opening the door; the control unit controls the sensor indicator lamp to turn on, so that the user can accurately touch the sensor when he needs to open the outer door alone; the control unit controls the display screen lamp to turn on, so that the user can manipulate the display screen set. It may be appreciated that the control unit controls the display screen lamp to turn on, which means that the control unit controls the display screen to turn on; the control unit controls the door panel lamp to turn on, so that the user can accurately trigger the door-opening signal of the second refrigerating compartment according to the indication of the door panel lamp.

Further, the refrigerator further includes a lighting switch communicatively connected with the control unit. A specific position for mounting the lighting switch is not particularly limited in the present invention. It may be understood that the lighting switch may be disposed on the door body or on the cabinet, as long as it is convenient for the user to operate.

When the lighting switch is in an ON state, the control unit controls the illumination lamp, logo lamp, sensor indicator lamp, display screen lamp and door panel lamp to turn on; when the lighting switch is in an OFF state, the control unit controls the logo lamp, the sensor indicator lamp and the door panel lamp to turn on; thus, the user can selectively control a portion of the lighting lamp groups to turn on according to their own needs, enhancing the versatility of the refrigerator and achieving the energy-saving effect.

Further, as shown in the FIGURE, the present invention further provides a control method of the above-mentioned refrigerator. The control method comprises the following steps:

the control unit obtains the open state or closed state of the inner door;

when the inner door is in the closed state, after the sensor is triggered and a door-opening signal is fed back to the control unit, the control unit controls the unlocking unit to unlock the locking mechanism.

The step of the control unit obtaining the open state or closed state of the inner door is specifically: judging the open state or closed state of the inner door according to a level output by the Hall element. Specifically, when the Hall element outputs a low level, the control unit judges that the inner door is in the closed state; when the Hall element outputs a high level, the control unit judges that the inner door is in the open state.

After the sensor is triggered, only when the inner door is in the closed state will the control unit control the unlocking unit to unlock the locking mechanism so that the user can open the outer door alone, thereby avoiding damages caused by collision between the inner door and the outer door when the outer door is opened, and also avoiding simultaneous opening of the inner door and outer door and facilitating the user to use and achieve the energy-saving effect.

In a specific embodiment, the control unit obtains the open state or closed state of the inner door before the sensor is triggered; certainly, the present disclosure is not limited thereto. It may be understood that the control unit may obtain the open state or closed state of the inner door after the sensor is triggered, so long as it can be ensured that only when the inner door is in the closed state can the control unit control the unlocking unit to unlock the locking mechanism.

Further, before the control unit obtains the open state or closed state of the inner door, the control method further includes the following steps:

the human-sensing module senses the human-sensing signal and feeds it back to the control unit.

After receiving the human-sensing signal fed back by the human-sensing module, the control unit judges that the user might perform the next operation on the refrigerator. At this time, the control unit judges the open state or closed state of the inner door to control the unlocking unit according to the open state or closed state of the inner door after the user triggers the sensor.

Further, after the control unit receives the human-sensing signal fed back by the human-sensing module, the control method further comprises the following steps: the control unit controls at least a portion of the lighting lamp groups to turn on so that the user views and performs relevant operations.

The present invention does not limit the sequence of performing the step of the control unit controlling at least a portion of the lighting lamp groups to turn on and the step of the control unit obtaining the open state or closed state of the inner door. It may be understood that after receiving the human-sensing signal fed back by the human-sensing module, the control unit may preferentially control at least a portion of lighting lamp groups to turn on and then obtain the open state or closed state of the inner door, or the control unit may preferentially obtain the open state or closed state of the inner door and then control at least a portion of lighting lamp groups to turn on, or the control unit performs the two schemes simultaneously.

Further, the control unit controlling at least a portion of the lighting lamp groups to turn on specifically comprises the following steps: judging a state of the lighting switch, the control unit controlling the illumination lamp, logo lamp, sensor indicator lamp, display screen lamp and door panel lamp to turn on when the lighting switch is in an ON state; when the lighting switch is in an OFF state, the control unit controls the logo lamp, the sensor indicator lamp and the door panel lamp to turn on; thus, the user can selectively control a portion of the lighting lamp groups to turn on according to their own needs, enhancing the versatility of the refrigerator and achieving the energy-saving effect.

To conclude, in the present invention, only when the inner door is in the closed state can the outer door be opened alone, thereby avoiding damages caused by collision between the inner door and the outer door when the outer door is opened, and also avoiding simultaneous opening of the inner door and outer door and facilitating the user to use and achieve the energy-saving effect.

It should be understood that although the description is described according to the embodiments, not every embodiment only includes one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A refrigerator, comprising a cabinet, a door body which surrounds together with the cabinet to form a refrigerating compartment, and a control unit, the door body comprising an inner door and an outer door rotatably coupled to the cabinet, the refrigerator further comprising a locking mechanism for locking the outer door and an unlocking mechanism for unlocking the outer door, the unlocking mechanism comprising a sensor disposed on the outer door and configured to obtain a door-opening signal of the outer door, and an unlocking unit for unlocking the locking mechanism, the sensor and the unlocking unit being both communicatively connected with the control unit; wherein the refrigerator further comprises a detection unit which is configured to detect an open state or a closed state of the inner door and is communicatively connected with the control unit; the control unit controls the unlocking unit to unlock the locking mechanism upon receiving the door-opening signal of the sensor and judging that the inner door is in the closed state.

2. The refrigerator according to claim 1, wherein the refrigerator further comprises a human-sensing module communicatively connected with the control unit, and the control unit obtains a feedback signal from the detection unit when the control unit receives a human-sensing signal fed back by the human-sensing module.

3. The refrigerator according to claim 2, wherein the outer door is configured as a transparent door body, and the refrigerator further comprises a plurality of lighting lamp group communicatively connected with the control unit, and the control unit controls at least a portion of the lighting lamp groups to turn on after the control unit receives the human-sensing signal.

4. The refrigerator according to claim 3, wherein the refrigerator further comprises a display screen set disposed on the door body, a second refrigerating compartment and a door-opening sensing plate disposed on the door body and configured to open the second refrigerating compartment; the plurality of lighting lamp groups comprise an illumination lamp disposed in the first refrigerating compartment, a logo lamp for lighting a logo of the refrigerator, a sensor indicator lamp corresponding to the sensor, a display screen lamp for lighting a display and control screen set, and a door panel lamp for lighting the door-opening sensing plate.

5. The refrigerator according to claim 4, wherein the refrigerator further comprises a lighting switch communicatively connected with the control unit; when the lighting switch is turned on, the control unit controls the illumination lamp, logo lamp, sensor indicator lamp, display screen lamp and door panel lamp to turn on; when the lighting switch is turned off, the control unit controls the logo lamp, the sensor indicator lamp and the door panel lamp to turn on.

6. The refrigerator according to claim 1, wherein the detection unit comprises a magnet disposed on one of the inner door and the cabinet, and a Hall element disposed on the other of the inner door and the cabinet, and the Hall element communicatively connected with the control unit.

7. A control method of a refrigerator, wherein the refrigerator is configured as the refrigerator according to claim 1, and the control method comprises the following steps:

the control unit obtains the open state or closed state of the inner door;

when the inner door is in the closed state, after the sensor is triggered and a door-opening signal is fed back to the control unit, the control unit controls the unlocking unit to unlock the locking mechanism.

8. The control method of a refrigerator according to claim 7, wherein the refrigerator further comprises a human-sensing module communicatively connected with the control unit; before the control unit obtains the open state or closed state of the inner door, the control method further comprises the following steps:

the human-sensing module senses the human-sensing signal and feeds it back to the control unit.

9. The control method of a refrigerator according to claim 8, wherein the outer door is configured as a transparent door body, the refrigerator further comprises a plurality of lighting lamp groups communicatively connected with the control unit, the control method further comprises a step of the control unit controlling at least a portion of the lighting lamp groups to turn on, after the control unit receives the human-sensing signal fed back by the human-sensing module and before the sensor is triggered.

10. The control method of a refrigerator according to claim 9, wherein the refrigerator further comprises a display screen set disposed on the door body, a second refrigerating compartment, a door-opening sensing plate disposed on the door body and configured to open the second refrigerating compartment, and a lighting switch communicatively connected with the control unit; the plurality of lighting lamp groups comprise an illumination lamp disposed in the first refrigerating compartment, a logo lamp for lighting a logo of the refrigerator, a sensor indicator lamp corresponding to the sensor, a display screen lamp for lighting a display and control screen set, and a door panel lamp for lighting the door-opening sensing plate; the control unit controlling at least a portion of the lighting lamp groups to turn on specifically comprises the following steps: judging a state of the lighting switch, the control unit controlling the illumination lamp, logo lamp, sensor indicator lamp, display screen lamp and door panel lamp to turn on when the lighting switch is in an ON state; when the lighting switch is in an OFF state, the control unit controls the logo lamp, the sensor indicator lamp and the door panel lamp to turn on.

* * * * *